United States Patent [19]

Libit

[11] 3,951,291

[45] Apr. 20, 1976

[54] CHILD-RESISTANT CONTAINER CLOSURE

[76] Inventor: Sidney M. Libit, 441 Lakeside Terrace, Glencoe, Ill. 60022

[22] Filed: Sept. 10, 1975

[21] Appl. No.: 611,998

[52] U.S. Cl. ..... 215/220; 215/272; 215/295; 215/221

[51] Int. Cl.[2] ..... B65D 55/02; B65D 85/56; A61J 1/00

[58] Field of Search ..... 215/9, 220, 221, 272, 215/295, 301

[56] References Cited

UNITED STATES PATENTS

| | | | |
|---|---|---|---|
| 3,848,761 | 11/1974 | Lifit | 215/220 |
| 3,893,582 | 7/1975 | Kowalik | 215/221 |

*Primary Examiner*—George T. Hall

[57] ABSTRACT

A so-called child-resistant closure for a container containing a substance which may be injurious to the person, especially to a child of tender years, e.g. poisonous household items such as rat poison. The closure is desirably molded in one piece and comprises two principal parts, one part adapted to be engaged and disengaged with a pouring neck of the container, e.g. a screw threaded connection, to obturate the opening thereof and another part surrounding the first and angularly and/or translationally displaceable relative thereto. Each of the parts is respectively provided with cams and cam followers so arranged that when the outer or surrounding part is angularly displaced with respect to the inner or surrounded part, as by grasping and turning, and/or shifting linearly, the cams and followers are engaged to exert inward radial force to supplement normal grip of the closure on the container neck.

12 Claims, 8 Drawing Figures

FIG. 5
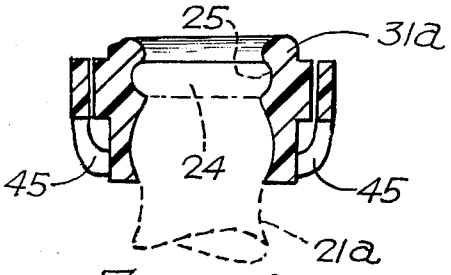
FIG. 1
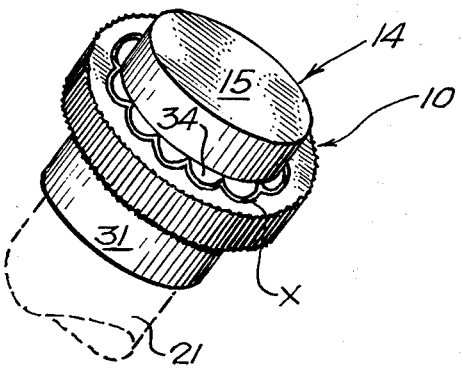
FIG. 6
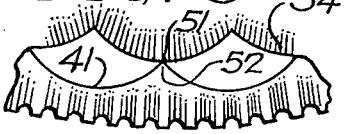
FIG. 7
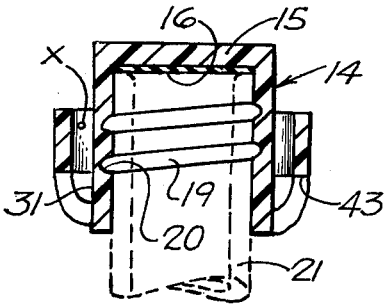
FIG. 2a
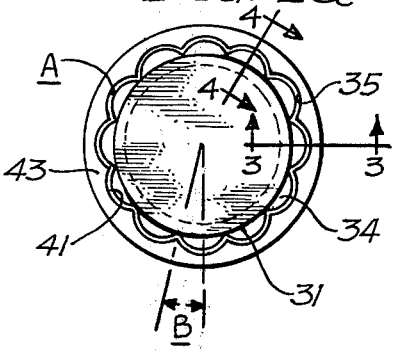
FIG. 3
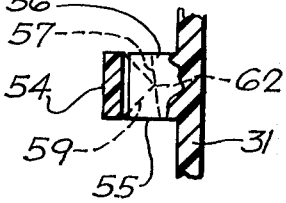
FIG. 4
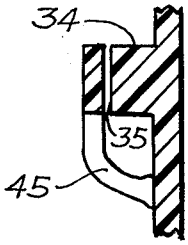
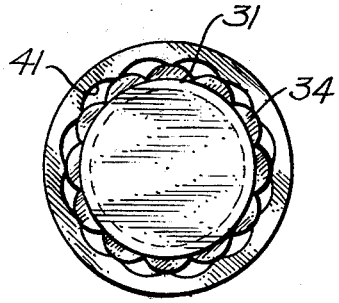
FIG. 2b

CHILD-RESISTANT CONTAINER CLOSURE

BACKGROUND OF THE INVENTION

Since Federal laws and regulations promulgated thereunder require that closures as referred to satisfy certain testing procedures before being approved for sale in commerce, there has been a resurgence in recent years of concepts for child-resistant closures, especially those which are simple and have features rendering operation obvious to an adult but not to a child and involve low cost. An important factor is the cost of molds for fabricating the part. Ideally, a one-piece closure of proper construction will most likely be the cheapest to produce and the simplest to operate.

The larger volume of conventional, re-usable caps for containers are those held on the neck of the container by screw-threads, and by this I include bayonet forms of attachment. The remainder is made up of caps which are engaged with a bead-and-groove feature. In any case engagement is the result of simple rotation or thrusting and pulling of the cap.

I am aware that closures functioning similarly to that disclosed herein have been known, e.g. in U.S. Pat. Nos. 810,736 and 1,341,177 but these have proved unreliable, expensive and difficult to operate. The present disclosure relates to improvements in such closures.

SUMMARY OF THE INVENTION

The disclosure has reference to a closure for a container provided with a neck through which the contents of the same may be poured. The closure and neck each have complementary threads or a bead and groove by means of which the closure may be engaged with or disengaged from the neck. The closure comprises two principal parts, a generally cylindrical body and an annular member encircling the body, the latter being referred to sometimes herein as the "band". The body and band are so configured that they may be molded in one piece, although the features of the invention may be realized by using two pieces separately molded and then joined for convenience in stocking and handling. In use the body is screwed to or forced on to the neck of the container. In the initial filling and capping of the container automatic machinery is employed, and the invention closure is adapted to accomodate the chuck of the capping machine.

The device is preferably molded of a plastics composition in one piece, e.g. polyethylene, polypropylene or comparable resin.

The band which encircles the body is linked to the body by one or more ligaments to preserve a one-to-one relationship between the body and band. These ligaments are flexible and tenacious to allow for displacement of the band with respect to the body when locking and unlocking the two.

The band is provided on its interior with a plurality of lobes or protuberances herein termed "cams" adapted, upon relative rotation of the body and band, to be displaced radially outwardly and the body is provided with a plurality of lobes or protuberances (herein termed "cam followers") adapted, upon relative rotation of the body and band to be moved radially by the cams. The camming surfaces are shaped as to convert rotational movement of the band, i.e. clockwise, into radially inward displacement or squeezing of the wall of the body, and consequent enhanced grip of the body on the neck. Removal of the closure is the reverse of the foregoing.

In a subsidiary aspect the invention includes detent means between the cams and cam followers to insure that the same remain in active position pending deliberate release by the user.

BRIEF DESCRIPTION OF THE DRAWING

FIG. 1 is a fragmentary perspective view of a closure embodying the principles of the invention, shown in operative relation to a bottle;

FIG. 2*a* is a top plan view of the closure in unlocked condition;

FIG. 2*b* is the same as FIG. 2*a* except in locked condition;

FIG. 3 is a cross-sectional detail, on the line 3—3 of FIG. 2*a*, to show an alternative form of the locking feature;

FIG. 4 is a cross section on the line 4—4 of FIG. 2*a;*

FIG. 5 is a vertical, medial cross section of an alternative form of the closure;

FIG. 6 is a detail in top plan to show the detent means for implementing the locked-up condition; and FIG. 7 is a vertical, medial cross section of the device.

DESCRIPTION OF THE PREFERRED EMBODIMENTS

The invention closure will be described in relation to bottles as commonly used for carbonated beverages which, quite often, are consumed a little at a time and re-closed. However, closure means known to me which will seal effectively under the attendant gas pressure are unreliable so that the contents become flat quite rapidly. The use of a sheet metal cap of the threaded type permits leakage, even though manually tightened to some considerably degree. The present invention contemplates a closure which may be secured to a large extent by means of interengaging threades or a bead-and-groove feature and which may be given a final angle of twist which will implement the initial sealing of the container by radially-applied force.

Thus, there is provided a one-piece closure of some plastics composition having good elastic memory, viz. deformable but capable of recovering to substantially its as-molded condition. Acceptable plastics are such resins as polyethylene and polypropylene. These are characterized by being inert to attack by foods and other substances to which the human body may be exposed and are accepted as "safe" by governmental regulatory agencies.

In one form of the invention the closure 10 comprises a cylindrical cap or shell 14 having one end closed by a top 15 (FIG. 7) below which there may be provided a resilient liner 16, as is well-known. Engagement of the cap 14 with the container 21 is by means of screw threads 19 and 20 on the neck and on the interior of the closure, respectively although, in a modified form, the principles of the invention may be incorporated in a closure for a beaded neck container (FIG. 5) in which the conventional bead 24 at the end of the neck 21*a* fits frictionally into a complementary groove 25 in the interior of the device.

The exterior of the lateral wall 31 of the cap is provided at approximately its mid-point with a plurality of cams 34 having an active cam surface 35, e.g. corresponding to a longitudinal cylindrical segment. Desirably the active cam surfaces 35 are symmetrical about a center line X—X allowing for relative rotation either clockwise or counterclockwise to lock up or release the cams and cam followers.

The cam followers 41 are preferably female counterparts of the cams 34 and are spaced from the latter by a small clearance A to avoid jamming. The cam followers 41 are formed in an annular member or band 43 supported on the exterior surface 31 of the body, as by ligaments 45 (FIG. 4). These latter are so structured as to permit rotation of the band over an angle B which will shift all of the cams 34 against the followers 41 (FIG. 2*b*) whereby the band is stretched and the shell 31 is compressed to apply radial forces to this latter. The net effect of applying compression to the body will be consequent additional securement of the cap on the bottle neck.

The total radial displacement of each follower with respect to its individual cam has been exaggerated in the drawing. It will be understood that the degree of expansion of the band 10 depends on the physical characteristics of the plastics composition employed, and similarly with regard to compression of the wall 31. Thus, in a typical closure, the radial displacement of the band 43 may be on the order of 0.016 inch. It will be comprehended that if this displacement is made more than sufficient, excessive grip during rotation of the cams and followers would seriously impair the manipulation of the device and particularly and locking-up action and, vice versa, if the displacement were to be made less than some minimum the desired compression of the device on the bottle will not be achieved. Nor is it essential that the exterior or working surface of the cams be curvilinear but these may be simple inclined planes or a combination of such planes with a curvilinear section or sections. In this way some preferred mechanical advantage may be achieved, e.g. a gradual initial application of torque to the band ending with a final torque which will provide an indication to the user that maximum lock-up has been attained.

In order to insure that the band may not, following lock-up, inadvertently slip from its engaged position, detent action may be provided (FIG. 6) in the form of cusps 51 adapted to engage in companion depressions 52. If the nature of the material permits, the cusp may form its own seat by cold working. However, the better alternative would be to deliberately provide a depression. By so doing the user would feel engagement taking place by reason of the snap action and would be warned against forcing the parts beyond their intended maximum angular displacement.

Desirably the periphery of the band 43 is knurled, as best shown in FIG. 1, to provide a friction surface.

If desired, the circumfentially directed lock-up force may be supplemented by an axial force, i.e. following rotation of the band to locked-up position, some additional grip may be realized by force applied axially. To this end, and referring to FIG. 3, the cam followers 56 may be provided with an inclined working face 57 and the cams 59 with a substantially conical working end 62. In this way the rotational displacement between the cams and cam followers may be succeeded by an axial displacement, the end 62 sliding on the inclined face 57 whereby to increase the tension in the band 54. The abutment of the end 62 with the surface 57 may, if desired, include the detent feature as described in connection with FIG. 6.

Release of the band from locked-up condition is obviously the reverse of the locking-up operation already described.

It is preferred that the conformation of the working position of each of the cams and cam followers will be so selected as to result in maximum radial compression of the annular member 10, and hence optimum locked-up condition. However, appropriate recognition must also be taken of the necessity of maintaining the locked-up condition against relese by a child.

Irrespective of actuation of the band, whether rotated to locked-up condition, axially shifted to supplemented, locked-up condition or a combination of both, the ligaments 45 are sufficiently shape-retaining and flexible to maintain a predetermined idle relation of the parts and to permit that degree of relative displacement required to assume the locked-up condition. Additionally, the configuration of the ligaments 45 relative to the other parts is preferably such as to permit withdrawing the one-piece device from the mold without the use of expensive retractable cores.

I claim:

1. In combination with a container having a pouring neck provided with means to attach a closure thereto, a closure to be attached to said means, said closure having a generally hollow cylindrical body closed at one end, an annular member encircling the body and flexibly connected thereto to allow limited angular displacement of the member relative to the body, said member comprising material which is resilient but generally shape-retaining, said member having a plurality of cams extending inwardly thereof and said body having a plurality of cam followers extending outwardly thereof, said cams and cam followers regarded as sets confronting one another and having respective surfaces adapted to co-act in camming relation upon relative rotation of the body and annular member to translate angular displacement of the member into radial force on the body to tighten the closure onto the neck.

2. The combination in accordance with claim 1 in which each of the cams presents a surface to its individual follower which is inclined to the path of movement of the follower.

3. The combination in accordance with claim 1 in which each of the plurality of cams is convex and each of the plurality of followers has a cusp, adapted to slide on its individual follower to result in maximum radial compression of the band for minimum sliding friction of the cusp and follower.

4. The combination in accordance with claim 1 in which the working surface of each of the cams is wedge shaped including an apex and the cooperative working surface of each of the cam followers is a surface which is inclined to the path of the cams, each apex sliding on the inclined surface individual thereto to translate circular movement of the band into radial constriction thereof.

5. A closure having a hollow cylindrical body for securement to the neck of a container by frictional engagement thereover and adapted to be additionally locked to the neck by peripheral constriction of the body following application of normal force, said body having a top adapted to obturate the neck opening and the lateral wall thereof depending from the top, a circular band encircling said wall and coaxial therewith, a flexible ligament extending between the band and body to retain the band in operative position on the body and to limit rotational displacement of the band relative to the body, a plurality of camming surfaces on said band and a mating plurality of camming surfaces on the exterior of said wall, one individual to each of the first plurality of surfaces adapted to mutually abut upon such displacement, said mating pluralities of surfaces when abutted converting said circular displacement into radial compression of said lateral wall to supplement the grip of the wall on said neck, at least said lateral wall comprising deformable but generally shape-retaining material.

6. The combination in accordance with claim 5 wherein each of said first plurality of surfaces is plane inclined with respect to the axis of the closure and each of said second plurality of surfaces is a projection extending radially inwardly of the closure, all of said inclined surfaces taken as a group conforming substantially to the lateral surface of a cone whereby axial force applied to the band in the direction of the base of the cone will compress the lateral wall to implement grip of the closure on the neck.

7. A closure to obturate the opening in the pouring neck of a container comprising a cylindrical body including means to attach the closure to the neck, said body having a top and a skirt depending from said top, at least said skirt comprising deformable, yet generally shape-retaining material, movable means carried on said body for axial shifting relative thereto, cam means and cam follower means carried on said body and movable means respectively, shifting of said movable means causing abutment of said cam means and follower means to convert axial movement of said movable means into radial compression of the skirt to implement engagement of the skirt on the neck.

8. The closure in accordance with claim 7 further characterized in that said movable means is a band encircling the skirt.

9. The closure in accordance with claim 8 wherein means are provided to flexibly attach the band to the skirt to permit movement of the band between idle and active positions and to preclude separation of the band from the skirt.

10. The closure in accordance with claim 8 wherein said cam means comprises a plurality of protuberances on the interior surface of the band and said follower means comprises a plurality of pads on the exterior surface of the skirt.

11. The closure in accordance with claim 7 further characterized by detent means between the cam means and follower means to maintain said radial compression pending release thereof pursuant to reverse movement of the movable means.

12. The closure in accordance with claim 1 further characterized by detent means between the cam means and follower means to maintain said radial compression pending release thereof pursuant to reverse movement of the movable means.

* * * * *